US012509963B2

(12) United States Patent
Leiper et al.

(10) Patent No.: US 12,509,963 B2
(45) Date of Patent: Dec. 30, 2025

(54) HYDRAULIC ACTUATOR DEVICE

(71) Applicant: Viking Completion Technology FZCo, Dubai (AE)

(72) Inventors: Simon Peter Leiper, Dubai (AE); Bartosz Krupski, Dubai (AE)

(73) Assignee: VIKING COMPLETION TECHNOLOGY, Fzco Dubai (AE)

( * ) Notice: Subject to any disclaimer, the term of this patent is extended or adjusted under 35 U.S.C. 154(b) by 0 days.

(21) Appl. No.: 18/675,001

(22) Filed: May 27, 2024

(65) Prior Publication Data

US 2024/0410253 A1 Dec. 12, 2024

(30) Foreign Application Priority Data

Jun. 8, 2023 (GB) ..... 2308518

(51) Int. Cl.
*E21B 34/06* (2006.01)
*E21B 34/14* (2006.01)

(52) U.S. Cl.
CPC ..... *E21B 34/142* (2020.05); *E21B 34/063* (2013.01); *E21B 2200/04* (2020.05)

(58) Field of Classification Search
CPC ..... E21B 34/142; E21B 34/063
See application file for complete search history.

(56) References Cited

U.S. PATENT DOCUMENTS 2,017,353 A * 10/1935 Parks ..... E21B 43/121 417/138
6,390,193 B1 * 5/2002 Martin ..... E21B 17/06 166/250.08
6,505,684 B2 1/2003 Rayssiguier et al.
10,408,005 B2 * 9/2019 Richards ..... E21B 33/1275
2006/0278399 A1 12/2006 Dwivedi et al.
2013/0075109 A1 3/2013 Frisby et al.
2018/0023358 A1 1/2018 Moyes
2019/0093459 A1 3/2019 Mau et al.
2022/0049569 A1 2/2022 Alexander et al.

FOREIGN PATENT DOCUMENTS

WO 2019066947 A1 4/2019

OTHER PUBLICATIONS

Intellectual Property Office of the UK Patent Office; Search Report for GB2407511.1 Nov. 21, 2024; one page; Intellectual Property Office of the UK Patent Office, Newport, South Wales, United Kingdom.

(Continued)

*Primary Examiner* — Kenneth L Thompson
(74) *Attorney, Agent, or Firm* — LAW OFFICE OF JESSE D. LAMBERT LLC

(57) ABSTRACT

A hydraulic actuator device to activate multiple completion accessories in an oil, gas or other subterranean well from a single hydraulic control line running from the surface, through the wellhead, and down through the well. The hydraulic actuator device is mounted in the control line and selectively diverts flow between a through bore and a conduit in a spur. An embodiment of using the device to activate a chemical injection valve and after installing a lift system with activation of a hydrostatic drain valve to provide the head of fluid, using the device to activate a hydraulic drain valve.

21 Claims, 2 Drawing Sheets

(56) References Cited

OTHER PUBLICATIONS

Intellectual Property Office of the UK Patent Office; Combined Search and Examination Report for GB2407511.1; Nov. 22, 2024; one page; Intellectual Property Office of the UK Patent Office, Newport, South Wales, United Kingdom.
United Arab Emirates Ministry of Economy; Substantive Examination Report for P2024-01440; Dec. 16, 2024; one page; UAE Ministry of Economy, Liwa Tower, Al Khaleej Arabi St. Abu Dhabi, UAE P.O Box 901 AD.
United Arab Emirates Ministry of Economy; Search Report for P2024-01440; Dec. 16, 2024; two pages; UAE Ministry of Economy, Liwa Tower, Al Khaleej Arabi St. Abu Dhabi, UAE P.O Box 901 AD.
United Arab Emirates Ministry of Economy; Office Action Summary (Examination Result) for P2024-01440; Dec. 16, 2024; five pages; UAE Ministry of Economy, Liwa Tower, Al Khaleej Arabi St. Abu Dhabi, UAE P.O Box 901 AD.

* cited by examiner

HYDRAULIC ACTUATOR DEVICE

BACKGROUND OF THE INVENTION

The present invention relates to an apparatus and method for activating multiple completion accessories in an oil, gas or other subterranean well from a single hydraulic control line running from the surface, through the wellhead, and down through the well.

It is well known in the art to operate a tool such as a completion accessory from a control line run to surface. The control line runs down the side of the production tubing and by pumping fluid through the conduit of the control line the tool can be hydraulically actuated. A difficulty arises when more than one tool requires to be actuated remotely downhole as there is a limit to the number of control lines which can be installed.

SUMMARY OF THE INVENTION

It is an object of the present invention to provide a hydraulic actuator device and a method of actuating multiple completion accessories in a well from a single control line.

According to a first aspect of the present invention there is provided a hydraulic actuator device for operating a plurality of completion accessories from a single control line arranged on the outside of production tubing in a well, the hydraulic actuator device comprising:

a substantially cylindrical body having through bore with a first end configured to be coupled to the control line, the through bore providing a first fluid flow path to a first accessory;

at least one fluid diversion unit, each fluid diversion unit comprising: a ball seat located in the through bore and a conduit providing a supplementary fluid flow path from the through bore to a further accessory, the ball seat being located downhole from the conduit; and the conduit including a pressure release member.

In this way, actuation of more than one accessory can be obtained via a single control line from surface. The first accessory can be actuated from fluid flow through the control line from surface, with the pressure release member preventing flow to the further accessory. When the further accessory requires to be actuated a ball can be dropped to seal the through bore and raise pressure in the conduit sufficient to actuate the pressure release member and fluid flow through the conduit will actuate the further accessory. Increasing pressure in the through bore can release the ball from the ball seat and allow further actuation of the first accessory.

Preferably the pressure release member is a burst disc. More preferable the burst disc is calibrated to rupture at a controlled pressure from surface. The pressure is varied by the pumping rate of fluid in the control line.

Preferably the conduit also includes a check valve. The check valve may be positioned upstream of the pressure release member. The check valve prevents fluids returning up the conduit back into the through bore.

There may be any number of fluid diversion units arranged in sequence along the control line to sequentially actuate further accessories.

The ball seat may be deformable for use with a hardened drop ball. Alternatively, the device includes a plastically deformable ball to be extruded through a ball seat.

Preferably the device includes a catcher sleeve located downhole of the ball seat. The catcher sleeve acts as a ball catcher to retain drop balls in the through bore.

Preferably the device is mounted in an upper completion in the well. The first accessory may be a chemical injection valve mounted upstream of the device. More preferably the first accessory has minimal restrictions to flow through it and operates without creating a head of fluid above the first accessory. The further accessory may be a drain valve. The drain valve may be operable by either hydrostatic or hydraulic means. More preferably the further accessory, once actuated, restricts the flow of fluid through the further accessory. In this way fluid pressure can build up behind the ball within the through bore to expel the ball. There may be more than one drain valve. The upper completion may also include a shearable latch anchor as is known in the art. A lower completion comprising a packer and further accessories such as screens and flow valves will also be present as is known in the art.

According to a second aspect of the present invention there is provided a method of actuating a plurality of accessories in a well, comprising the steps:

(a) locating a hydraulic actuator device according to the first aspect in a control line above a first accessory;

(b) connecting the conduit to a second accessory;

(c) operating the first accessory by pumping fluid down the through bore of the control line;

(d) launching a drop ball down the through bore to locate in the ball seat;

(e) increasing fluid pressure in the through bore to open the pressure release member; and (f) operating the further accessory.

In this way, a single control line is used to operate two accessories in sequence.

Preferably the method includes the step of increasing fluid pressure in the through bore to expel the ball through the ball seat. The method may then include the step of operating the first accessory again. The method may include retaining the ball in a ball catcher/screen before it reaches the first accessory.

The method may include locating a plurality of fluid diversion units in the through bore, each conduit being connected to a separate accessory. On expelling the ball through the ball seat, the ball will locate in a lower ball seat and allow the next accessory in sequence to operate.

The method may include at step (c) introducing production chemicals to produced fluid by actuating a chemical injection valve as the first accessory.

The method may include the step of installing a lift system into the well. The method may further include the step of operating a hydrostatic drain valve to create a head of fluid for operation of the lift system. Preferably, the further accessory is a hydraulic drain valve located above the hydrostatic drain valve and operated at step (e) after the lift system is installed.

BRIEF DESCRIPTION OF DRAWINGS

Embodiments of the present invention will now be described with reference to the following figures, by way of example only, in which.

DETAILED DESCRIPTION OF THE INVENTION

Figure 1:
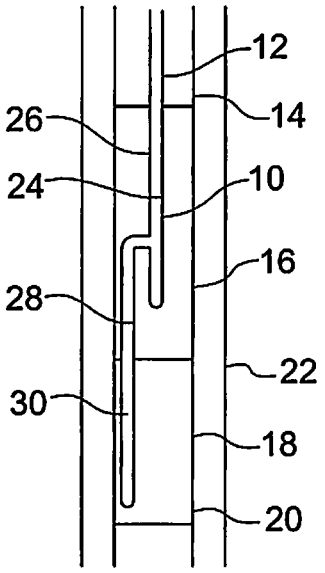
FIG. 1 shows a hydraulic actuator device on a control line to operate first and second accessories in a completion oilwell completion according to an embodiment of the present invention.
Figure 2:
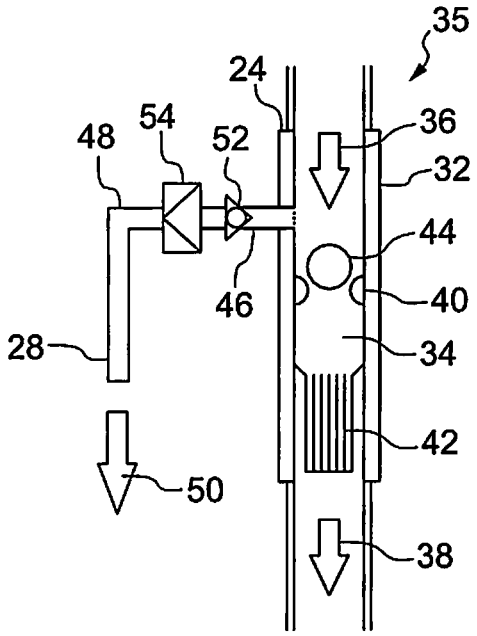
FIG. 2 is a schematic illustration of a hydraulic actuator device according to an embodiment of the present invention.

Reference is initially made to FIG. 1 and FIG. 2 of the drawings which illustrate a hydraulic actuator device, indicated by reference numeral 10, connected in a control line 12 arranged against production tubing 14 to operate a first accessory 16 and a second accessory 18 of a completion string 20, independently of each other, in a well 22 according to an embodiment of the present invention.

The hydraulic actuator device 10 is connected at a first end 24 to an upper section 26 of the control line 12 and at a second end 28 to lower section 30 of the control line 12. The control line 12 is a standard tubing mounted on the outside of the production tubing 14 which carries hydraulic pressure/flow of hydraulic fluid from surface to hydraulically operate a completion accessory 16,18 in a well 22. The device 10 has a substantially cylindrical body 32 with a through bore 34 for fluid flow 36 from the control line 12 to flow 38 into the first accessory 16 for hydraulic actuation thereof. The device 10 includes a fluid diversion unit 35. In the through bore 34 there is a ball seat 40, made from a malleable material, and a catcher screen 42 for retaining an activation ball 44, which is made a solid non-deformable material. Upstream of the ball seat 40 is a spur 46 providing a conduit 48 for the passage of fluid to flow 50 out of the through bore 34. Conduit 48 has mounted therein a check valve 52 biased to allow fluid from the control line 12 to move in flow direction 50 but not allow it to return. The conduit 48 also contains a calibrated burst disc 54. Conduit 48 is connected at the second end 28 to the second accessory 18.

Figure 3:
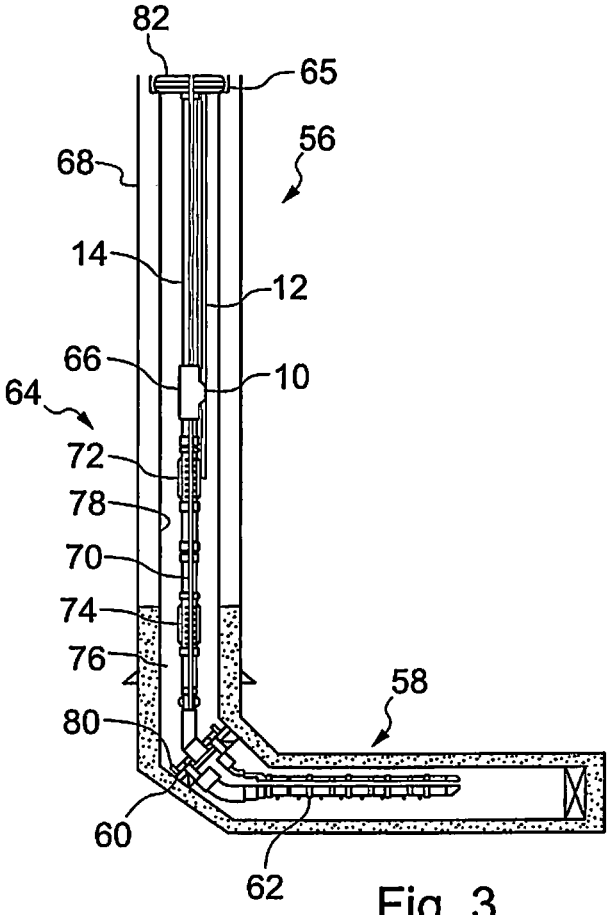
FIG. 3 shows an upper oilwell completion and lower oilwell completion with a control line including a hydraulic actuator device according to an embodiment of the present invention.

Operation of the hydraulic actuator device 10 will now be described by way of example with reference to FIG. 3, FIG. 4 and FIG. 5. In FIG. 3 there is illustrated a well completion 56 as is known in the art. The lower completion 58 consists of an oilwell packer 60 and below that some screens and flow control valves, generally indicated at 62, none of which are essential to the invention.

The upper completion 64 consists of: a chemical injection valve 66 for injecting chemicals from surface 65 through the wellbore 68 into the produced fluid 70 within the production tubing 14; a first drain valve 72, which is a hydraulic drain valve being a communication valve which is activated by the device 10 using a hydraulic chamber (see FIG. 5); a second drain valve 74 which is hydrostatic drain valve, being a similar communication valve which opens upon application of annular pressure (defined as the annulus 76 between the well casing 78 and the production tubing 14) and which is stroked by hydrostatic pressure; a shear-able anchor latch 80 which latches into a mating profile in the packer 60 and which also forms a seal between the tubing 14 and the annulus 76 between the tubing 14 and the well casing wall 78. It is shown that the chemical injection valve 66 is connected by a single hydraulic control line 12 to the surface 65 which emerges through the wellhead 82.

At the location of the chemical injection valve 66, the control line 12 has the hydraulic actuator device 10 mounted therein as described with reference to FIG. 1 and FIG. 2, with the first accessory 16 being the chemical injection valve 66 and the second accessory 18 being the hydraulic drain valve 72. The device 10 may be attached to the control line 12 at any position upstream of the chemical injection valve 66.

To better understand the invention, a chemical injection valve (FIG. 4) and a drain valve (FIG. 5) will now be described.

Figure 4:
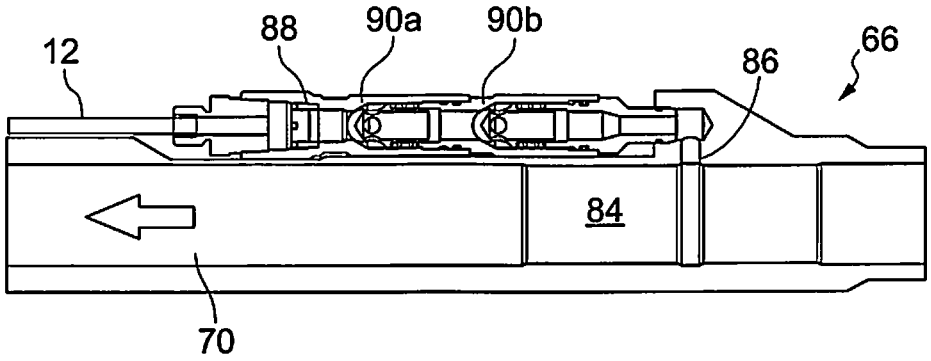
FIG. 4 is an illustration of chemical injection valve, used in the arrangement of FIG. 3.

FIG. 4 shows a typical chemical injection valve 66. It comprises a substantially cylindrical body located in the completion string 20 and has a through bore 84 connected to the production tubing 14 for the passage of produced fluid 70 to surface 65. Adjacent to the through bore 84, the valve 66 is connected to the control line 12 and has a burst disc 88, two check valves 90*a,b* and a port 86 accessing the through bore 84. Pressure is applied to the control line 12 which ruptures a burst disc 88 at a calibrated pressure allowing injection of chemicals into the produced fluid 70. The chemicals pass through the two check valves 90*a,b* with biasing means to prevent produced fluid 70 from entering the control line 12 yet allow the chemicals to pass into the produced fluid 70 with minimal effort.

Figure 5:
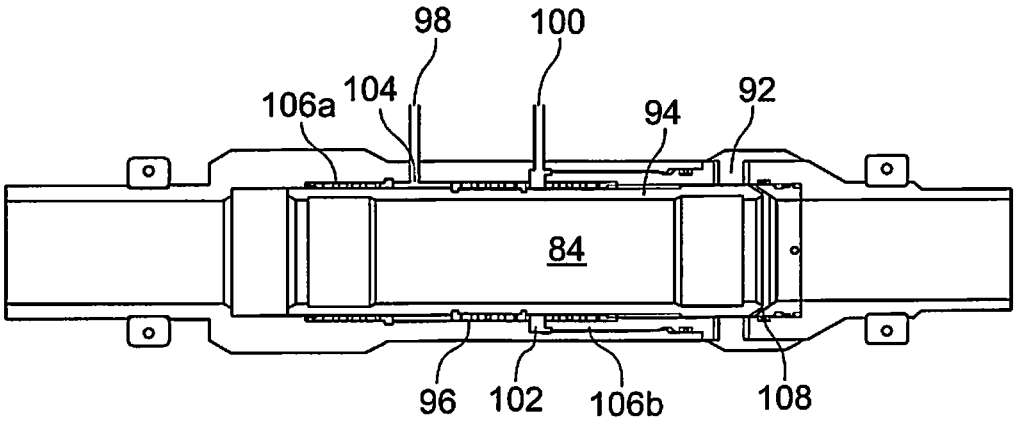
FIG. 5 is an illustration of drain valve, used in the arrangement of FIG. 3.

FIG. 5 shows a drain valve 72,74 which can be configured to be operable by either hydrostatic or hydraulic means. It comprises a substantially cylindrical body located in the completion string 20 and has a through bore 84 connected to the production tubing 14 for the passage of produced fluid 70 to surface 65. There are communication ports 92 which provide access from the through bore 84 to the annulus 76 outside the valve 72,74 through the body. A sleeve 94 located in the body which can open and close the ports 92. A travelling seal 96 between the sleeve 94 and the body creates a hydrostatic chamber 104 or a hydraulic chamber 102 with static seals 106*a,b* respectively. A hydrostatic communication port 98 accesses the hydrostatic chamber 104 and a hydraulic communication port 100 accesses the hydraulic chamber 102 as required. Moving the sleeve 94 away from a nose seal 108 opens the communication ports 92 allowing communication between the inside and outside of the valve. The valve 72,74 can be configured in two ways: hydraulic activation by applying pressure to the hydraulic communication port 100 and leaving the hydrostatic communication port 98 open moves the sleeve 92 to the open position. A biasing means (not shown) prevents it from moving back; and hydrostatic activation which relies on trapping a volume of atmospheric air inside the hydrostatic chamber 104 and sealing the hydrostatic communication port 98. It is functioned by applying an over pressure to the annulus 76 outside the valve, which ruptures a calibrated burst disc (not shown) in the hydraulic communication port 98. This allows the naturally occurring hydrostatic pressurized fluid in the wellbore 68 to flood the hydraulic chamber 102, moving the sleeve 94 to the open position.

In operation, during the early production phase of the well the chemical injection valve 66 is opened to introduce production chemicals such as corrosion inhibitors into the produced fluid 70. This is done by pressurizing the control line 12 to burst the calibrated disc 88. For the purposes of explanation let us assume this is 2,000 psi. After opening chemicals can be pumped through the check valves 90*a,b* with little effort however the check valves prevent fluid pressure from entering the control line 12. This is an important and often legally required safety features of such devices. Later in the production phase once the well pressure has reduced due to depletion it may be desirable to install a plunger lift system (not shown) into the well. This would be run on steel rods placed above the chemical injection valve 66 and functions by reciprocation by the pump jack located at surface 65. The plunger lift systems require a head of fluid above the pump inside the tubing to casing annulus 76 to operate efficiently. This is done by flooding the annulus 76 with produced fluid and in this case by opening the hydrostatic drain valve 74. Annular applied pressure opens this valve 74 allowing the annulus 76 to fill with fluid. It is desirable to open a second hydraulic drain valve 72 located above the hydrostatic drain valve which presents a challenge. Since the annulus 76 is now open to the tubing 14 it is not possible to use annular pressure. The chemical injection valve 66 burst disc 88 was functioned in the early production phase and it is now no longer possible to pressurize the hydraulic control line 12. In order to operate hydraulic drain valve 72 it is necessary to employ the hydraulic actuation device 10.

The hydraulic actuation device 10 is located in the control line 12, as described with reference to FIG. 1, upstream of the chemical injection valve 66. During chemical injection, chemicals have been pumped down the control line 12, in flow 36 (see FIG. 2) to pass down the through bore 34 and flow 38 into the chemical injection valve 66 (see FIG. 4). The burst disc 54 at the spur 46 prevents any chemicals from entering the conduit 48. When activation of the hydraulic drain valve 72 is required, chemical injection is stopped, a solid ball 44 is launched from surface 65 using a pump and panel with integrated ball launcher (not shown) and pumped down the control line 12 with hydraulic oil. The deformable ball seat 40 catches the ball with pressure noted at surface. Pressure is increased to rupture the burst disc 54 (for example 4,000 psi). Fluid flow 18 exits the conduit 48 and enters the hydraulic drain valve 72 at the hydraulic communication port 100. As described hereinbefore with reference to FIG. 5, the sleeve 94 in the drain valve 72 will shift and the operator can count strokes at surface. The check valve 52 prevents the sleeve 94 from returning. Once fully stroked pressure will increase (for example 6,000 psi) extruding the ball 44 through the ball seat 40 landing in the bypass catcher screen 42. With the through bore 34 of device 10 clear, chemical injection can resume.

It will be recognised that multiple fluid diversion units 35 could be arranged in the control line 12 to allow multiple completion accessories to be functioned in a similar manner by removing the catcher sleeve 94 so that when the ball 44 is extruded and ejected from the ball seat 40 it passes to another lower ball seat to repeat the function. This could be repeated as many times as required activating multiple devices until the ball is either ejected from the control line or lands in a final lower most device's catcher sleeve. Such an application could use drain valves in multiple production zones separated by packers with control line bypass.

While the completion accessories are described as a hydrostatic and a hydraulic drain valve, any completion accessories could be used, for example, a hydrostatic or hydraulic packer. In the embodiment described, a hydrostatic drain valve could be used in place of the hydraulic drain valve where the diverted pressure ruptures the disc and allows a hydrostatic chamber to be closed by the well's hydrostatic pressure. Alternatively or additionally, multiple identical completion accessories could be used, being activated in sequence as required. For example, multiple chemical injection valves to be opened in the same production string replacing the drain valves in the embodiment described.

The principle advantage of the present invention is it provides a hydraulic actuator device and a method of actuating multiple completion accessories in a well from a single control line.

A further advantage of the present invention is that it provides a hydraulic actuator device and a method of actuating multiple completion accessories in a well from a single control line in which a first accessory can be reactivated after other accessories have been activated.

It will be appreciated to those skilled in the art that various modifications may be made to the invention herein described without departing from the scope thereof. For example, while a ball seat and activation ball are described, any projectile such as a dart, could be used to travel down the control line and locate in a recess to create the required temporary seal in the through bore. For the drain valves, any valves could be used, for example sliding sleeve door valves. Another alternative could use a ball valve or flapper valve in the production stream.

We claim:

1. A hydraulic actuator device to operate a plurality of completion accessories from a single control line, the single control line and hydraulic actuator device arranged on the outside of production tubing in a well, the hydraulic actuator device comprising:

a substantially cylindrical body having a through bore with a first end configured to be coupled into and continue a through bore of the control line, the through bore providing a first fluid flow path to a first accessory;

at least one fluid diversion unit, each fluid diversion unit comprising: a ball seat located in the through bore and a conduit providing a supplementary fluid flow path from the through bore to a further accessory, the ball seat being located downhole from the conduit; and the conduit including a pressure release member.

2. A hydraulic actuator device according to claim 1 wherein the pressure release member is a burst disc.

3. A hydraulic actuator device according to claim 2 wherein the burst disc is calibrated to rupture at a controlled fluid pressure from surface.

4. A hydraulic actuator device according to claim 1 wherein the conduit also includes a check valve.

5. A hydraulic actuator device according to claim 4 wherein the check valve is positioned upstream of the pressure release member.

6. A hydraulic actuator device according to claim 1 wherein there are a plurality of fluid diversion units in the device.

7. A hydraulic actuator device according to claim 1 wherein the ball seat is deformable for use with a hardened drop ball.

8. A hydraulic actuator device according to any preceding claim wherein the device includes a plastically deformable ball.

9. A hydraulic actuator device according to any preceding claim wherein the device includes a catcher sleeve located downhole of the ball seat.

10. A hydraulic actuator device according to claim 1 wherein the first accessory is a chemical injection valve in an upper completion assembly.

11. A hydraulic actuator device according to claim 1 wherein the further accessory is a drain valve in an upper completion assembly.

12. A method of actuating a plurality of completion accessories in a well, comprising the steps:

(a) locating a hydraulic actuator device in a control line above a first accessory on the outside of a production tubing;

the hydraulic actuator device comprising: a substantially cylindrical body having a through bore with a first end configured to be coupled into and continue a through bore of the control line, the through bore providing a first fluid flow path to a first accessory; at least one fluid diversion unit, each fluid diversion unit comprising: a ball seat located in the through bore and a conduit providing a supplementary fluid flow path from the through bore to a further accessory, the ball seat being located downhole from the conduit; and the conduit including a pressure release member;

(b) connecting the conduit to a second accessory;

(c) operating the first accessory by pumping fluid down the through bore of the control line;

(d) launching a drop ball down the through bore of the control line to locate in the ball seat;

(e) increasing fluid pressure in the through bore of the control line to open the pressure release member; and (f) operating the further accessory.

13. The method of actuating a plurality of completion accessories in a well according to claim 12 wherein the method includes the step of increasing fluid pressure in the through bore to expel the drop ball through the ball seat.

14. The method of actuating a plurality of completion accessories in a well according to claim 13 wherein the method includes the further step of operating the first accessory again.

15. The method of actuating a plurality of completion accessories in a well according to claim 14 wherein the method includes the step of retaining the ball in a ball catcher/screen before it reaches the first accessory.

16. The method of actuating a plurality of completion accessories in a well according to claim 13 wherein the method includes locating a plurality of fluid diversion units in the through bore, each conduit being connected to a separate accessory and on expelling the ball through the ball seat, locating the ball in a lower ball seat and so allowing the next accessory in sequence to operate.

17. The method of actuating a plurality of completion accessories in a well according to claim 12 wherein the method includes at step (c) introducing production chemicals to produced fluid by actuating a chemical injection valve as the first accessory.

18. The method of actuating a plurality of completion accessories in a well according to claim 12 wherein the method includes the step of installing a lift system into the well.

19. The method of actuating a plurality of completion accessories in a well according to claim 18 wherein the method further includes the step of operating a hydrostatic drain valve to create a head of fluid for operation of the lift system.

20. The method of actuating a plurality of completion accessories in a well according to claim 19 wherein the further accessory is a hydraulic drain valve located above the hydrostatic drain valve and operated at step (e) after the lift system is installed.

21. A hydraulic actuator device to operate a plurality of completion accessories from a single control line arranged on the outside of production tubing in a well, the hydraulic actuator device comprising:

a substantially cylindrical body having a through bore with a first end configured to be coupled to the control line, the through bore providing a first fluid flow path to a first accessory;

at least one fluid diversion unit, each fluid diversion unit comprising: a ball seat located in the through bore and a conduit providing a supplementary fluid flow path from the through bore to a further accessory, the ball seat being located downhole from the conduit;

the conduit including a pressure release member and a check valve.

* * * * *